US009624617B2

(12) United States Patent
Leonard et al.

(10) Patent No.: US 9,624,617 B2
(45) Date of Patent: Apr. 18, 2017

(54) WASHING MACHINE APPLIANCE AND A METHOD FOR OPERATING A WASHING MACHINE APPLIANCE

(71) Applicant: General Electric Company, Schenectady, NY (US)

(72) Inventors: Ryan Ellis Leonard, Louisville, KY (US); Stephen Edward Hettinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 95 days.

(21) Appl. No.: 14/592,078

(22) Filed: Jan. 8, 2015

(65) Prior Publication Data

US 2016/0201242 A1 Jul. 14, 2016

(51) Int. Cl.

| | |
|---|---|
| ***D06F 33/02*** | (2006.01) |
| ***D06F 39/00*** | (2006.01) |
| ***D06F 39/08*** | (2006.01) |
| ***D06F 35/00*** | (2006.01) |

(52) U.S. Cl.

CPC ..... *D06F 39/003* (2013.01); *D06F 33/02* (2013.01); *D06F 35/00* (2013.01); *D06F 35/006* (2013.01); *D06F 39/00* (2013.01); *D06F 39/08* (2013.01); *D06F 39/088* (2013.01); *D06F 2202/085* (2013.01); *D06F 2202/10* (2013.01); *D06F 2204/086* (2013.01)

(58) Field of Classification Search

CPC ..... D06F 35/00; D06F 39/088; D06F 39/003; D06F 2202/10; D06F 2202/0856

USPC ..... 8/158; 68/12.05, 12.21

See application file for complete search history.

(56) References Cited

U.S. PATENT DOCUMENTS

| | | | | |
|---|---|---|---|---|
| 4,400,838 | A * | 8/1983 | Steers | D06F 39/003 68/12.19 |
| 5,074,003 | A * | 12/1991 | Manson | D06F 39/005 68/12.04 |
| 5,507,054 | A | 4/1996 | Blauert et al. | |
| 5,987,679 | A | 11/1999 | Won | |
| 6,029,298 | A * | 2/2000 | Dausch | D06F 39/003 68/12.05 |
| 6,842,929 | B2 | 1/2005 | Kim et al. | |
| 7,484,258 | B2 | 2/2009 | Kim et al. | |
| 8,215,134 | B2 | 7/2012 | Ashrafzadeh et al. | |
| 2005/0125909 | A1 * | 6/2005 | Bellinetto | D06F 39/087 8/158 |
| 2012/0060299 | A1 * | 3/2012 | Kim | D06F 21/08 8/137 |

(Continued)

FOREIGN PATENT DOCUMENTS

| | | | | |
|---|---|---|---|---|
| GB | 2051413 | A * | 1/1981 | D06F 39/003 |

*Primary Examiner* — Michael Barr
*Assistant Examiner* — Kevin G Lee
(74) *Attorney, Agent, or Firm* — Dority & Manning, P.A.

(57) ABSTRACT

A washing machine appliance and a method for operating a washing machine appliance are provided. The method includes steps to determine whether articles received in the washing machine appliance for washing were wet when loaded into the washing machine appliance such that one or more parameters of a wash cycle may be adjusted. The washing machine appliance includes features for determining whether articles received in the washing machine appliance for washing were wet when loaded into the washing machine appliance and for adjusting one or more parameters of a wash cycle.

14 Claims, 6 Drawing Sheets

(56) References Cited

U.S. PATENT DOCUMENTS

| | | | | |
|---|---|---|---|---|
| 2012/0210518 | A1* | 8/2012 | Bae | D06F 33/02 8/137 |
| 2014/0096327 | A1 | 4/2014 | Lee et al. | |
| 2015/0113740 | A1* | 4/2015 | Lee | D06F 39/003 8/137 |

* cited by examiner

WASHING MACHINE APPLIANCE AND A METHOD FOR OPERATING A WASHING MACHINE APPLIANCE

FIELD OF THE INVENTION

The present subject matter relates generally to washing machine appliances and methods for detecting wet laundry loads in washing machine appliances.

BACKGROUND OF THE INVENTION

Washing machine appliances generally include a tub for containing wash fluid, e.g., water, detergent, fabric softener, bleach, and/or combinations thereof, during operation of such washing machine appliances. A wash basket is rotatably mounted within the tub and defines a wash chamber for receipt of articles for washing. During operation of such washing machine appliances, wash fluid is directed into the tub and onto articles within the wash basket. The wash basket and/or an agitation element can rotate at various speeds to agitate articles within the wash basket in the wash fluid, to wring wash fluid from articles within the wash basket, etc.

During operating of certain washing machine appliances, a volume of water is directed into the tub to form wash fluid and/or rinse articles within the wash basket. Large loads can require a large volume of water relative to small loads that can require a small volume of water. Likewise, loads containing absorptive fabrics, such as cotton, can require a large volume of water relative to similarly sized loads containing certain synthetic fabrics, such as polyester or nylon. Further, loads of articles that were wet or saturated when loaded into the wash basket can require a smaller volume of water relative to similarly sized loads containing dry articles.

To operate efficiently, the various parameters of a wash cycle, such as, e.g., the volume of water directed into the tub, the duration of the wash cycle, the amount of agitation of the articles, etc., should be optimized for the composition of the load of articles within the wash chamber. However, washing machine appliances generally do not distinguish a wet load from a dry load and, thus, cannot optimize the wash cycle for a load of articles that was wet or saturated when placed into the wash basket.

Accordingly, a method for operating a washing machine appliance to determine whether a load of articles whether articles received in the washing machine appliance for washing were wet when loaded into the washing machine appliance would be useful. Further, a method of operating a washing machine appliance to adjust one or more parameters of a wash cycle if articles received in the washing machine appliance for washing were wet when loaded into the washing machine appliance would be advantageous. In addition, a washing machine appliance with features determining whether articles received in the washing machine appliance for washing were wet when loaded into the washing machine appliance and for adjusting one or more parameters of a wash cycle would be beneficial.

BRIEF DESCRIPTION OF THE INVENTION

The present subject matter provides a washing machine appliance and a method for operating a washing machine appliance. The method includes steps to determine whether articles received in the washing machine appliance for washing were wet when loaded into the washing machine appliance such that one or more parameters of a wash cycle may be adjusted. The washing machine appliance includes features for determining whether articles received in the washing machine appliance for washing were wet when loaded into the washing machine appliance and for adjusting one or more parameters of a wash cycle. Additional aspects and advantages of the invention will be set forth in part in the following description, or may be apparent from the description, or may be learned through practice of the invention.

In a first exemplary embodiment, a method for operating a washing machine appliance is provided. The washing machine appliance has a wash basket positioned within a tub, and the wash basket is configured to receive a load of articles for washing. The method includes the steps of initiating a wash cycle of the washing machine appliance; ascertaining a size of the load of articles within the wash basket; beginning to dispense fluid into the wash basket; determining whether a threshold fluid level has been reached and, if so, then ascertaining a dispensed fluid volume; determining whether the dispensed fluid volume is less than a wet load threshold volume and, if so, then adjusting one or more parameters of the wash cycle.

In a second exemplary embodiment, a method for operating a washing machine appliance is provided. The washing machine appliance has a wash basket positioned within a tub, and the wash basket is configured to receive a load of articles for washing. The method includes the steps of initiating a wash cycle of the washing machine appliance; ascertaining a size of the load of articles within the wash basket; beginning to dispense fluid into the wash basket; determining whether a threshold fluid volume has been dispensed and, if so, then ascertaining a fluid level within the wash basket; determining whether the fluid level is greater than a wet load threshold level and, if so, then adjusting one or more parameters of the wash cycle.

In a third exemplary embodiment, a washing machine appliance is provided. The washing machine appliance includes a tub; a wash basket positioned within the tub, the wash basket configured to receive a load of articles for washing; a spout configured for directing a flow of water to the wash basket; and a controller in operative communication with the plurality of valves. The controller is configured for initiating a wash cycle of the washing machine appliance; ascertaining a size of the load of articles within the wash basket; beginning to dispense fluid into the wash basket; determining whether a threshold fluid level has been reached and, if so, then ascertaining a dispensed fluid volume; determining whether the dispensed fluid volume is less than a wet load threshold volume and, if so, then adjusting one or more parameters of the wash cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
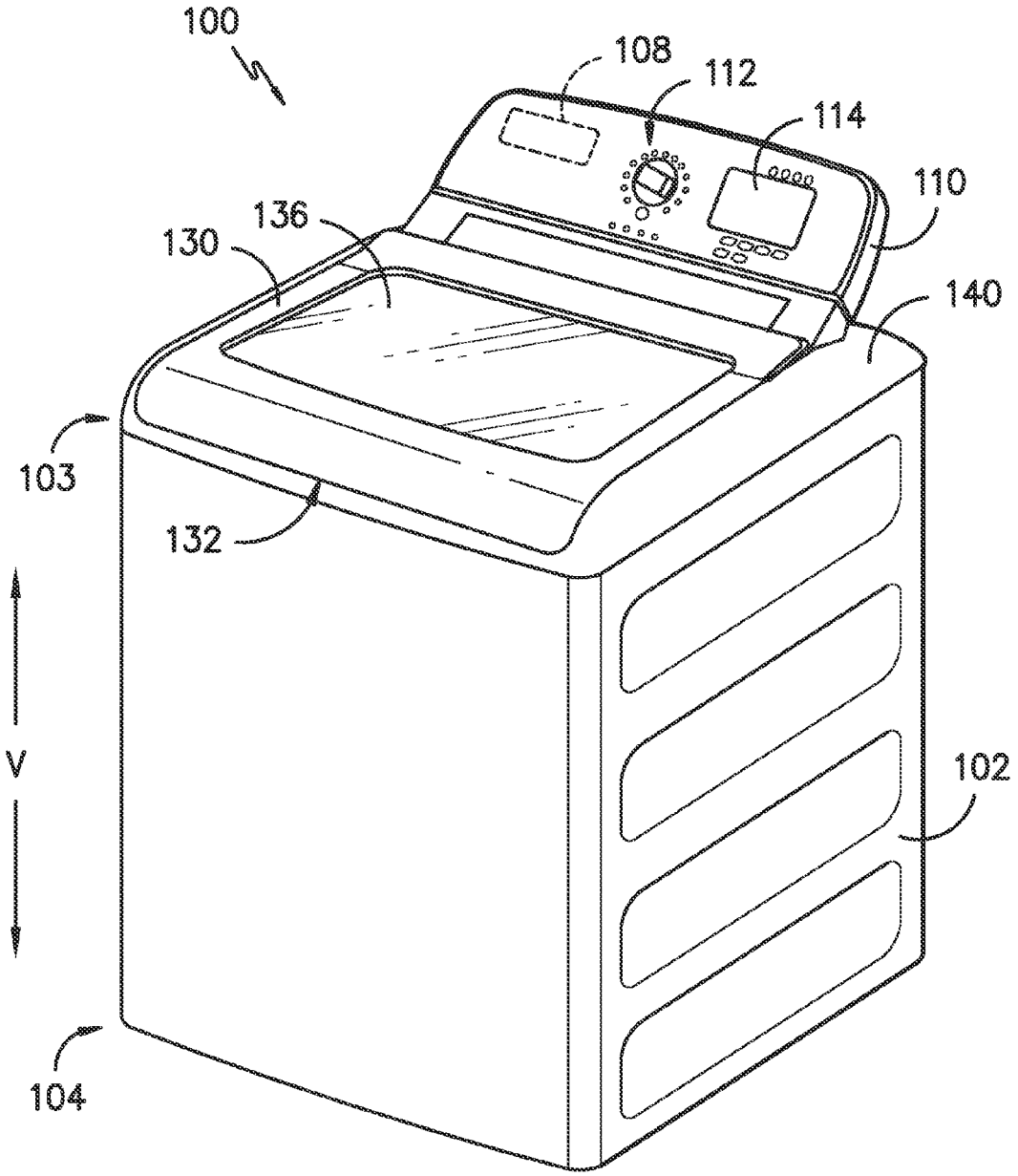
FIG. 1 illustrates an exemplary embodiment of a washing machine appliance of the present invention with a door shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
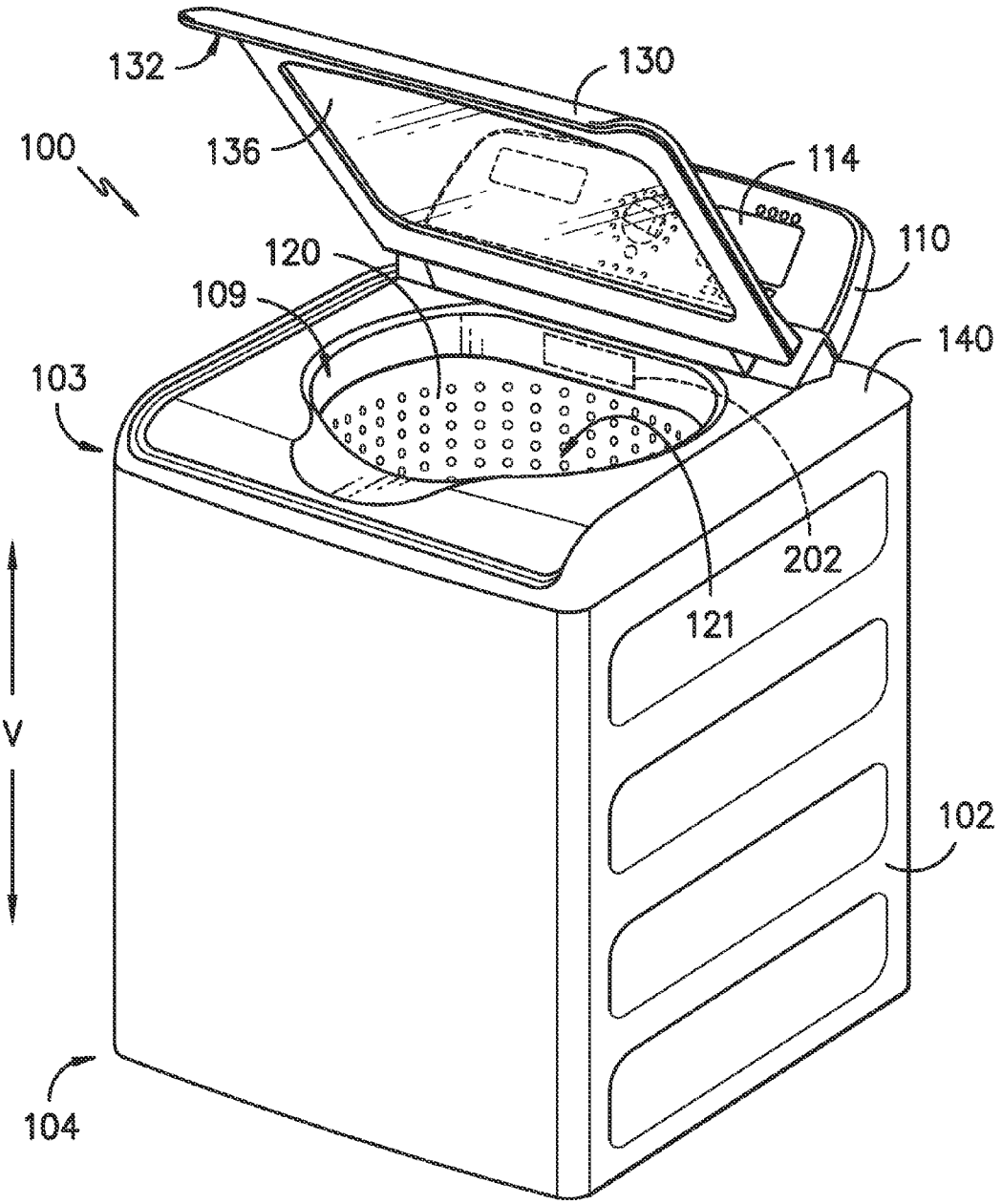
FIG. 2 illustrates the exemplary embodiment of a washing machine shown in FIG. 1 except with the door shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. Wash basket 120 is received within a wash tub or wash chamber 121 (FIG. 2) and is configured for receipt of articles 160 (FIG. 3) for washing. Wash tub 121 holds wash and rinse fluids for agitation in wash basket 120 within wash tub 121, as further described below.

Cabinet 102 of washing machine appliance 100 has a top panel 140. Top panel 140 defines an opening 109 (FIG. 2) that permits user access to wash basket 120 of wash tub 121. Door 130, rotatably mounted to top panel 140, permits selective access to opening 109; in particular, door 130 selectively rotates between the closed position shown in FIG. 1 and the open position shown in FIG. 2. In the closed position, door 130 inhibits access to wash basket 120. Conversely, in the open position, a user can access wash basket 120. A window 136 in door 130 permits viewing of wash basket 120 when door 130 is in the closed position, e.g., during operation of washing machine appliance 100. Door 130 also includes a handle 132 that, e.g., a user may pull and/or lift when opening and closing door 130. Further, although door 130 is illustrated as mounted to top panel 140, alternatively, door 130 may be mounted to cabinet 102 or any outer suitable support.

A control panel 110 with at least one input selector 112 (FIG. 1) extends from top panel 140. Control panel 110 and input selector 112 collectively form a user interface input for operator selection of machine cycles and features. A display 114 of control panel 110 indicates selected features, operation mode, a countdown timer, and/or other items of interest to appliance users regarding operation.

Figure 3:
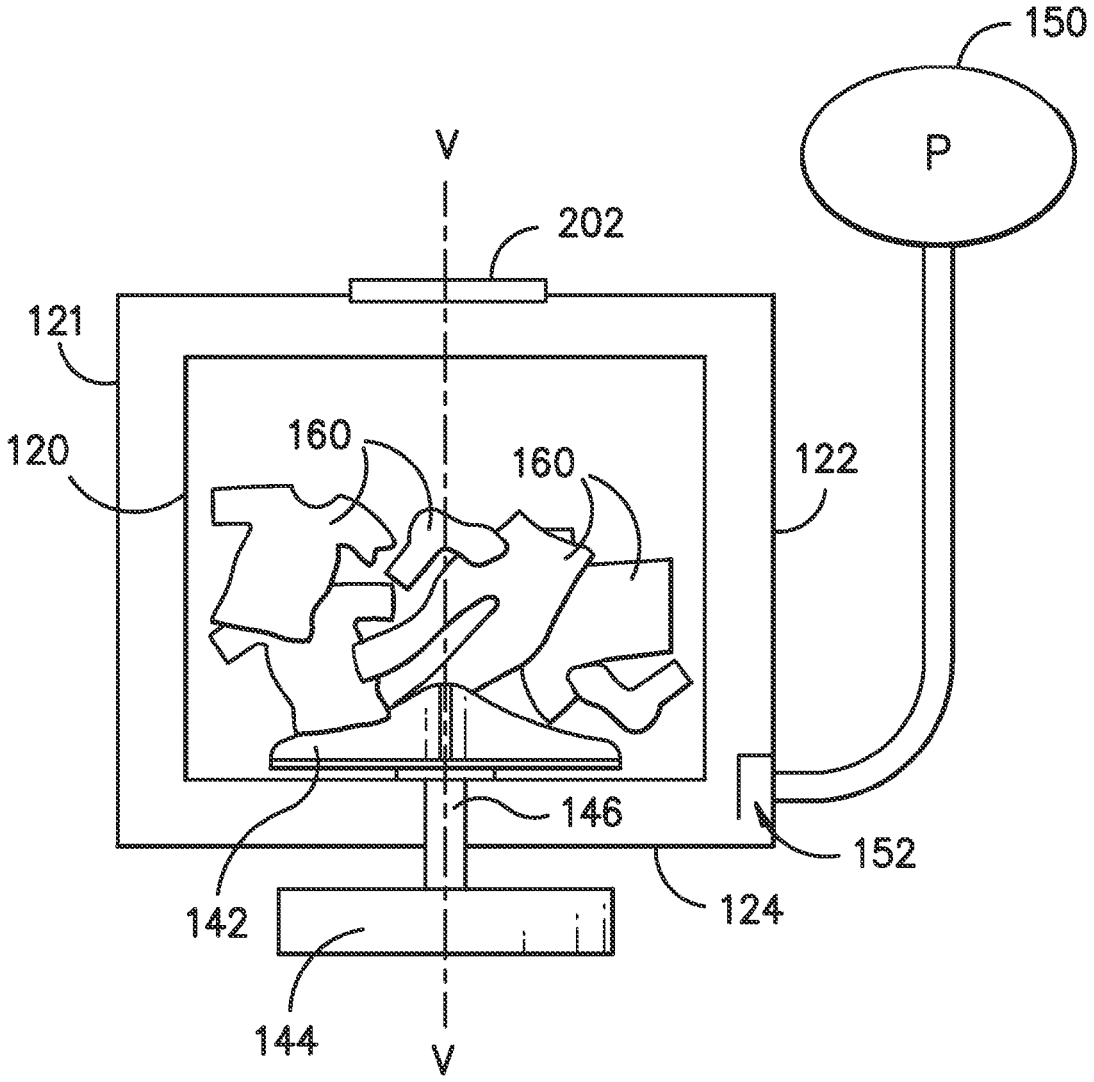
FIG. 3 provides a schematic view of the wash tub and wash basket of the washing machine appliance of FIG. 1.

FIG. 3 provides a schematic view of wash tub 121 and wash basket 120 of washing machine appliance 100. As may be seen in FIG. 3, tub 121 includes a bottom wall 124 and a sidewall 122. A wash drum or wash basket 120 is rotatably mounted within tub 121. In particular, wash basket 120 is rotatable about a vertical axis V. Thus, washing machine appliance is generally referred to as a vertical axis washing machine appliance. Basket 120 defines a wash chamber for receipt of articles 160 for washing. Wash basket 120 includes a plurality of openings or perforations (FIG. 2) therein to facilitate fluid communication between an interior of basket 120 and wash tub 121.

A spout 202 is configured for directing a flow of fluid into tub 121. In particular, spout 202 may be positioned at or adjacent a top portion of basket 120. Spout 202 may be in fluid communication with a water supply (not shown) to direct fluid (e.g., liquid water) into wash tub 121 and/or onto articles 160 within wash basket 120. A valve (not shown) regulates the flow of fluid through spout 202. For example, the valve can selectively adjust to a closed position to terminate or obstruct the flow of fluid through spout 202. A flow limiter also may be included such that a known flow rate is provided from the valve to spout 202. In addition, washing machine appliance 100 may include a fluid additive dispenser (not shown) for receipt of one or more fluid additives, e.g., detergent, fabric softener, and/or bleach, to dispense to articles 160 during one or more cycles of washing machine appliance 100. Further, a pump assembly (not shown) may be located beneath tub 121 and basket 120 for gravity assisted flow to drain tub 121.

An agitation element 142, shown as an impeller in FIG. 3, is disposed in wash basket 120 to impart an oscillatory motion to articles 160 and fluid in wash basket 120. In various exemplary embodiments, agitation element 142 includes a single action element (i.e., oscillatory only), double action (oscillatory movement at one end, single direction rotation at the other end) or triple action (oscillatory movement plus single direction rotation at one end, singe direction rotation at the other end). Agitation element 142 may have a variable stroke such that the agitation stroke may be adjusted for a given wash cycle.

As illustrated in FIG. 3, agitation element 142 is oriented to rotate about vertical axis V. Basket 120 and agitation element 142 are driven by a motor 144. As motor output shaft 146 is rotated, wash basket 120 and agitation element 142 are operated for rotatable movement within wash tub 121, e.g., about vertical axis V. Washing machine appliance 100 may also include a brake assembly (not shown) selectively applied or released for respectively maintaining wash basket 120 in a stationary position within wash tub 121 or for allowing basket 120 to spin within tub 121.

As further illustrated in FIG. 3, washing machine appliance 100 also includes a pressure sensor 150. Controller 108 is in communication with pressure sensor 150. Based at least in part on a signal from pressure sensor 150, controller 108 can determine a height or level of fluid within wash tub 121. Pressure sensor 150 includes an inlet 152 positioned on or at tub 121. For example, inlet 152 of pressure sensor 150 can be mounted to or positioned on sidewall 122 of wash tub 121. When fluid fills tub 121 to or above inlet 152 of pressure sensor 150, pressure sensor 150 can measure or detect pressure variations due to fluid filling tub 121. In particular, pressure sensor 150 can measure pressure increases as liquid fills wash tub 121, and controller 108 can correlate such pressure increase to a fluid level within tub 121. It should be understood that, in alternative exemplary embodiments, washing machine appliance 100 can include any other suitable sensor or device for measuring or determining the height or level of fluid within wash tub 121, such as a float switch or Hall Effect sensor.

Operation of washing machine appliance 100 is controlled by a controller or processing device 108 (FIG. 1) that is operatively coupled to control panel 110 for user manipulation to select washing machine cycles and features. In response to user manipulation of control panel 110, controller 108 operates the various components of washing machine appliance 100 to execute selected machine cycles and features.

Controller 108 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 100 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

In an illustrative embodiment, laundry items or articles 160 are loaded into wash basket 120 through opening 109, and washing operation is initiated through operator manipulation of input selectors 112. Wash tub 121 is filled with water and detergent and/or other fluid additives from, e.g., the fluid additive dispenser, to form wash and rinse fluids. One or more valves can be opened to initiate a flow of fluid into wash basket 120 via spout 202 for filling wash tub 121 to the appropriate level for the amount of articles 160 being washed and/or rinsed. By way of example for a wash cycle, once wash basket 120 is properly filled with fluid, the contents of wash basket 120 can be agitated (e.g., with agitation element 142) for washing of laundry items in wash basket 120.

After the agitation phase of the wash cycle is completed, wash tub 121 can be drained. Laundry articles 160 can then be rinsed by again adding fluid to wash basket 120 depending on the specifics of the cleaning cycle selected by a user. Agitation element 142 may again provide agitation within wash basket 120. One or more spin cycles also may be used. In particular, a spin cycle may be applied after the wash cycle and/or after the rinse cycle to wring wash fluid from articles 160 being washed. During a spin cycle, wash basket 120 is rotated at relatively high speeds. After articles 160 disposed in wash basket 120 are cleaned and/or washed, the user can remove the articles from wash basket 120, e.g., by reaching into wash basket 120 through opening 109.

While described in the context of a specific embodiment of washing machine appliance 100, using the teachings disclosed herein it will be understood that washing machine appliance 100 is provided by way of example only. Other washing machine appliances having different configurations (such as horizontal-axis washing machine appliances), different appearances, and/or different features may also be utilized with the present subject matter as well.

Figure 4:
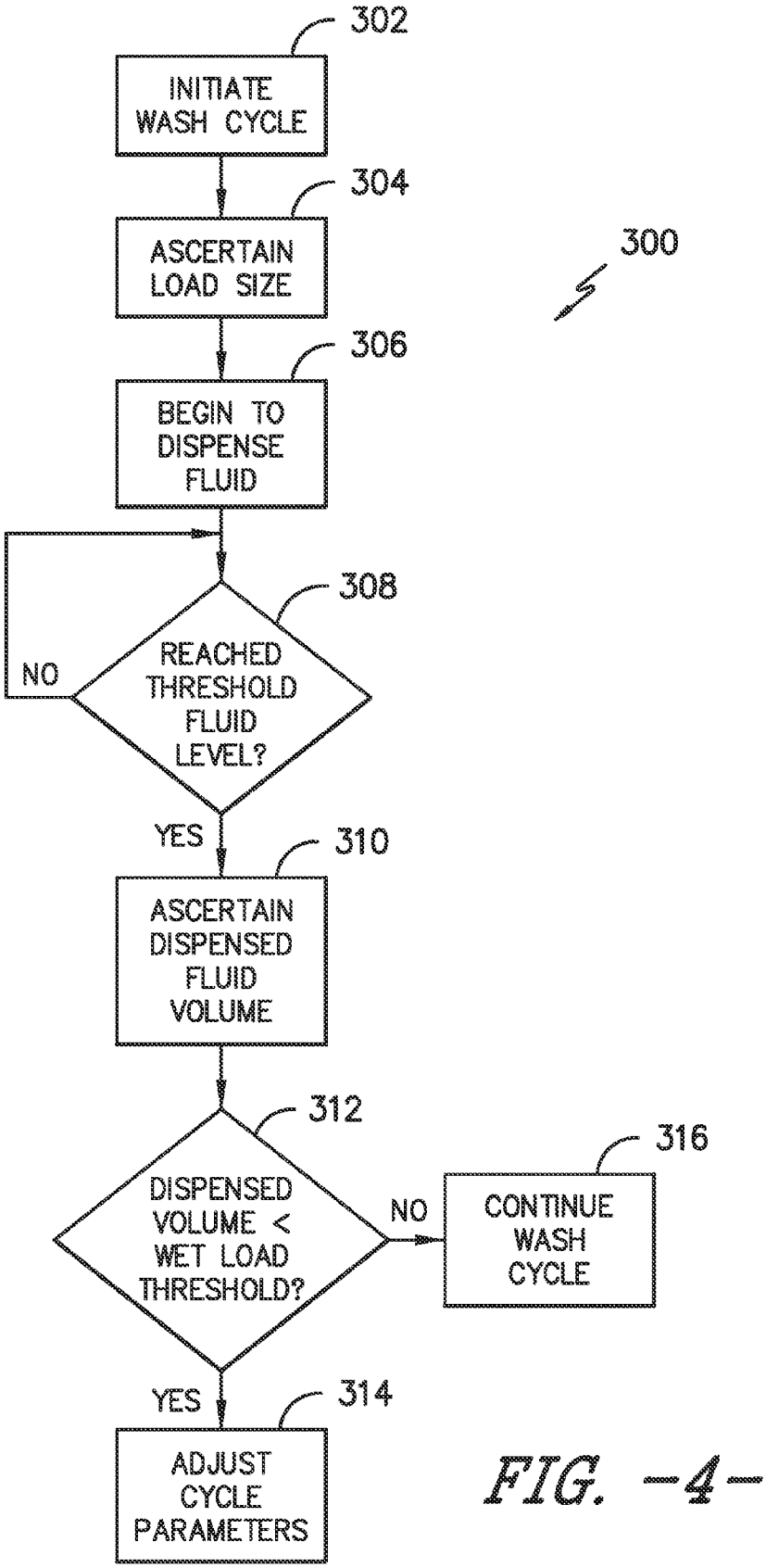
FIG. 4 provides a chart illustrating an exemplary method for operating a washing machine appliance according to the present subject matter.

FIG. 4 illustrates a method 300 of operating a washing machine appliance according to an exemplary embodiment of the present subject matter. Utilizing method 300, controller 108 can determine whether articles 160 within wash basket 120 were wet when they were placed in wash basket 120, which can be used to adjust the parameters of the wash cycle to optimize the wash and energy performance of washing machine appliance 100. Method 300 can be used to operate any suitable washing machine appliance, such as washing machine appliance 100 (FIG. 1). Further, method 300 may be programmed into and implemented in whole or in part by controller 108 (FIG. 1) of washing machine appliance 100.

As shown in FIG. 4, at step 302, a wash cycle of washing machine appliance 100 is initiated. The wash cycle may be initiated upon, e.g., the manipulation of one or more input selectors 112 by a user of washing machine appliance 100. The wash cycle may be initiated upon other inputs as well.

Once the wash cycle is initiated, controller 108 ascertains a size of the load of articles 160 in wash basket 120, as illustrated at step 304. In some embodiments, the load size may be ascertained by detecting a load size input by a user of washing machine appliance 100. For example, the user may manipulate one or more input selectors 112 to indicate the size of the load of articles 160 received in wash basket 120. Controller 108 may detect the manipulation of input selectors 112 as a load size input and ascertain the size of the load of articles 160 as the size indicated by the user.

In other embodiments, the load size may be ascertained by estimating the mass of the load of articles 160 in wash basket 120. As an example, controller 108 may estimate the mass of the load based upon the inertia of articles 160, which is determined by first rotating wash basket 120 with motor 144, e.g., controller 108 can activate the motor to rotate basket 120. Further, controller 108 can operate motor 144 such that basket 120 rotates at a predetermined frequency or angular velocity. The predetermined frequency or angular velocity can be any suitable frequency or angular velocity. For example, the predetermined frequency or angular velocity may be about one hundred and twenty revolutions per minute. Next, controller 108 can utilize motor 144 to adjust an angular velocity of basket 120. As an example, controller 108 can deactivate motor 144, e.g., by shorting the windings of the motor using any suitable mechanism or method, to adjust the angular velocity of basket 70. Then, controller 108 can determine an angular acceleration or first derivative of the angular velocity of basket 120, or a jerk or a second derivative of the angular velocity of basket 120, e.g., based at least in part the adjustment of the angular velocity of basket 120. Based upon the first and/or second derivative of the angular velocity of basket 120, controller 108 can estimate an inertial mass of articles 160 within wash basket 120. As an example, the magnitude of the first and/or second derivative of the angular velocity of basket 120 can be inversely proportional to the mass of articles 160 within wash basket 120. Thus, controller 108 can correlate the magnitude of the first and/or second derivative of the angular velocity of basket 120 to the mass of articles 160 within wash basket 120 at step 304. Controller 108 may also establish a tolerance range for the mass of articles 160 within wash basket 120 to correspond, e.g., to the error or uncertainty of the estimate of the mass of articles 160 within wash basket 120. Other ways of ascertaining the load size may be used as well.

After the size of the load of articles 160 is ascertained, method 300 includes step 306 of beginning to dispense fluid to wash basket 120. Fluid may be dispensed through, e.g., spout 202 by opening one or more valves as described above. The fluid dispensed to wash basket 120 may be liquid water or a combination of water and a fluid additive. Additionally, wash basket 120 may be rotated to evenly distribute the dispensed fluid to articles 160 within wash basket 120. Further, where one or more valves are opened to provide a flow of fluid through spout 202, controller 108 may begin counting a time that the one or more valves have been opened.

The dispensed fluid may be absorbed by articles 160 or may begin to accumulate in wash tub 121. At step 308, controller 108 may determine whether the level of fluid within wash tub 121 has reached at least a threshold fluid level. The fluid level within wash tub 121 may be determined using, e.g., pressure sensor 150, a float switch, or any other suitable device or devices. Thus, controller 108 may determine that the threshold fluid level has been reached, e.g., based on a signal from pressure sensor 150 indicating the fluid within wash tub 121 is at a predetermined height or level.

If, at step 308, the fluid level has not reached at least the threshold fluid level, fluid may continue to be dispensed, and method 300 may return to step 308 to determine whether the fluid level within wash tub 121 has reached at least the threshold fluid level. Otherwise, if controller 108 determines at step 308 the threshold fluid level has been reached, method 300 proceeds to step 310 and controller 108 ascertains the dispensed fluid volume. The dispensed fluid volume may be calculated, e.g., using a flow rate of the fluid delivered to spout 202 from the one or more valves and the time that the one or more valves have been open. For example, if fluid is provided to spout 202 at a flow rate of three gallons per minute and the one or more valves have been open for one minute, the dispensed fluid volume is three gallons. In other embodiments, the dispensed fluid volume may be ascertained using, e.g., a flow meter positioned to read the flow through spout 202. Other ways of ascertaining the dispensed fluid volume may also be used, and in some embodiments, the volume may not be calculated, but an amount of fluid dispensed may be represented, e.g., by the length of time the one or more valves have been open. Then, at step 312, controller 108 determines whether the dispensed fluid volume is less than a wet load threshold volume. If not, method 300 proceeds to step 316 and the wash cycle continues.

However, if at step 312 the dispensed fluid volume is less than the wet load threshold volume, controller 108 may determine that articles 160 were wet when the articles were loaded into wash basket 120 or before fluid was dispensed into basket 120. At step 314, controller 108 adjusts one or more parameters of the wash cycle based at least in part on the determination that articles 160 were wet before fluid was dispensed into wash basket 120. The parameters of the wash cycle may include, e.g., a volume of fluid dispensed for the wash cycle, a fluid level of the wash cycle, a stroke of agitator 142, a time articles 160 are agitated, a spin profile, a spin time, a soak time, and an amount of one or more fluid additives dispensed to wash basket 120. Other factors, such as, e.g., the size of the load of articles 160, also may affect which parameters are adjusted and how the parameters are adjusted at step 314. After adjusting the appropriate parameters of the wash cycle, the wash cycle may continue at step 316. In this way, the wash cycle can be optimized for the load of articles 160 within wash basket 120.

Accordingly, the wet load threshold volume may be used to determine whether a load of articles 160 within wash basket 120 was wet before fluid was dispensed into the wash basket. Wet laundry articles generally absorb less water than a load of synthetic or cotton articles or a mixed load of synthetic and cotton articles. Using, e.g., experimental data gathered prior to or during the manufacture of washing machine appliance 100 or other relevant data, one or more look-up tables, equations, transfer functions, and/or curves may be generated such that controller 108 may determine a load type of articles 160 in wash basket 120 based on, e.g., the dispensed fluid volume at the threshold fluid level. The wet load threshold volume may be determined in other ways as well.

As used herein, the term "load type" corresponds to an absorptivity of articles 160 within wash basket 120. As an example, if articles 160 within wash basket 120 have a relatively high absorptivity, the load type of such articles is a high absorption load type. Cotton articles can have a relatively high absorptivity such that a load of cotton articles is a high absorption load type. Conversely, if articles 160 within wash basket 120 have a relatively low absorptivity, the load type of such articles is a low absorption load type. Wet articles can have a relatively low absorptivity such that a load of wet articles is a low absorption load type. Synthetic articles, such as nylon or polyester articles, have a medium-low absorption load type, and a mixed or blended load of articles is a medium-high absorption load type. The load types may also be generally referred to as a cotton load type, a wet load type, a synthetic load type, and a mixed load type.

Figure 6:
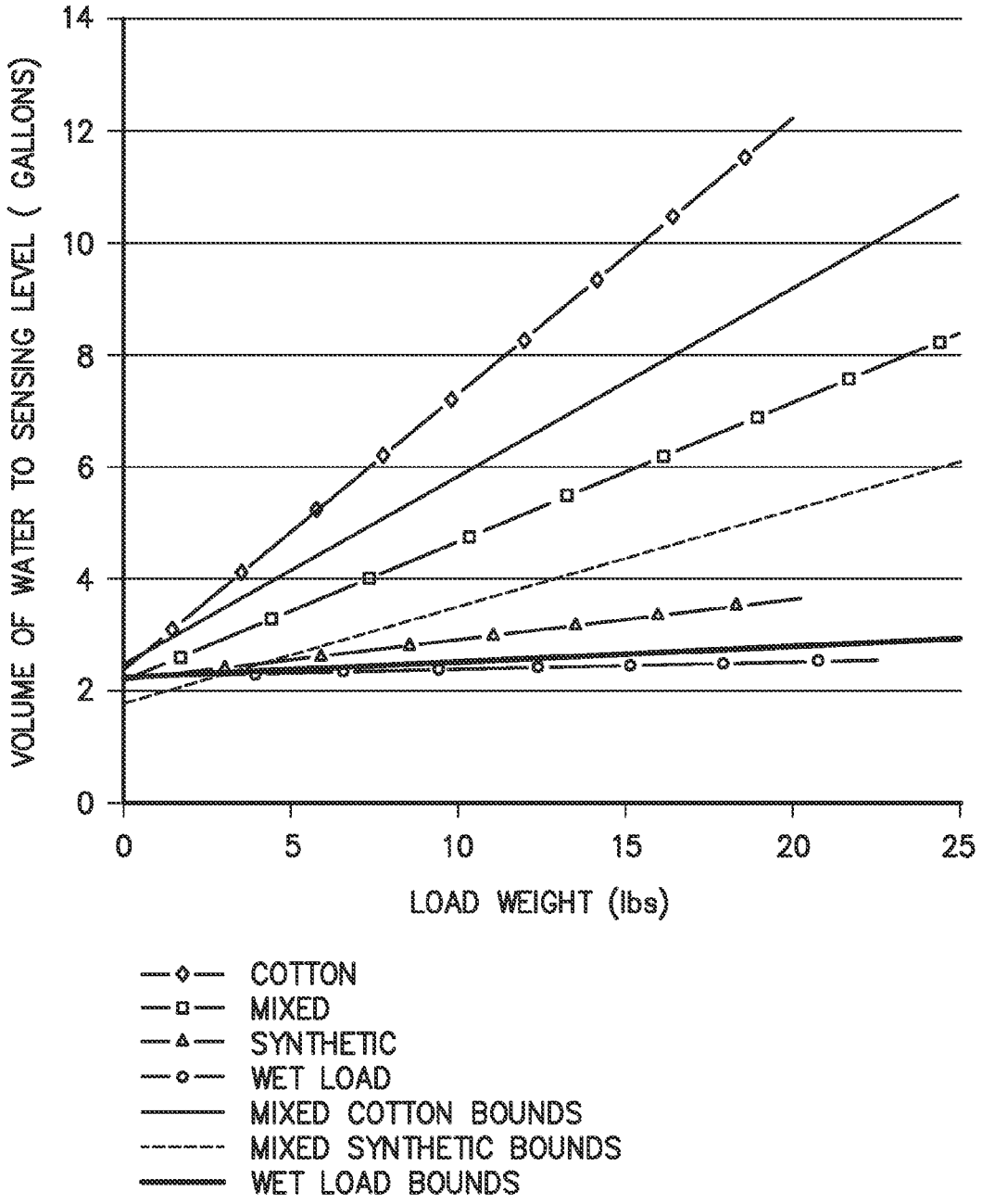
FIG. 6 provides a curve illustrating a wet load threshold for a range of load sizes according to an exemplary embodiment of the present subject matter.

FIG. 6 illustrates an exemplary curve generated from such data. The cotton, mixed, synthetic, and wet load lines represent, for those load types, the nominal or typical dispensed fluid volume required to reach the threshold fluid level for a range of load sizes. Boundary lines, such as a mixed-cotton bounds, a mixed-synthetic bounds, and a wet load bounds, may be ascertained based on, e.g., the tolerance range for the mass of the load of articles 160 used to ascertain the load size. For points above the mixed-cotton bounds, controller 108 may determine the load type is a cotton load. For points between the mixed-cotton bounds and the mixed-synthetic bounds, controller 108 may determine the load type is a mixed load. For points between the mixed-synthetic bounds and wet load bounds, controller 108 may determine the load type is a synthetic load. For points below the wet load bounds, controller 108 may determine the load type is a wet load. As a result, the wet load bounds may represent the wet load threshold volume over a range of load sizes.

Thus, using the load size ascertained at step 304, the load type may be determined based on the dispensed fluid volume ascertained at step 310. As an example, if the load size ascertained at step 304 is 10 pounds and if the dispensed fluid volume is ascertained as two gallons at step 310, controller 108 may determine the load type is a wet load, i.e., that the load of articles 160 was wet when placed in wash basket 120. As illustrated in FIG. 6, the wet load threshold volume may vary at least in part based on the load size ascertained at step 304 such that a larger load size may have a larger wet load threshold volume. Further, as will be readily understood, other means of determining the wet load threshold volume may be used, such as, e.g., when the load size is determined based on an input by the user of washing machine appliance 100.

Additionally, in some embodiments, the wet load threshold volume may be independent of the load size, such that controller 108 need not determine the size of the load of articles 160 within wash basket 120 to determine whether the load of articles was wet when loaded into basket 120. For example, a predetermined wet load threshold volume may be programmed into, e.g., controller 108. Accordingly, if at step 312 the dispensed fluid volume is less than the predetermined wet load threshold volume, controller 108 may determine that the load of articles was wet before any fluid was dispensed at step 306. Thus, in such embodiments, step 304 of determining the load size may be omitted for purposes of determining whether the load of articles 160 was wet before fluid was dispensed.

Figure 5:
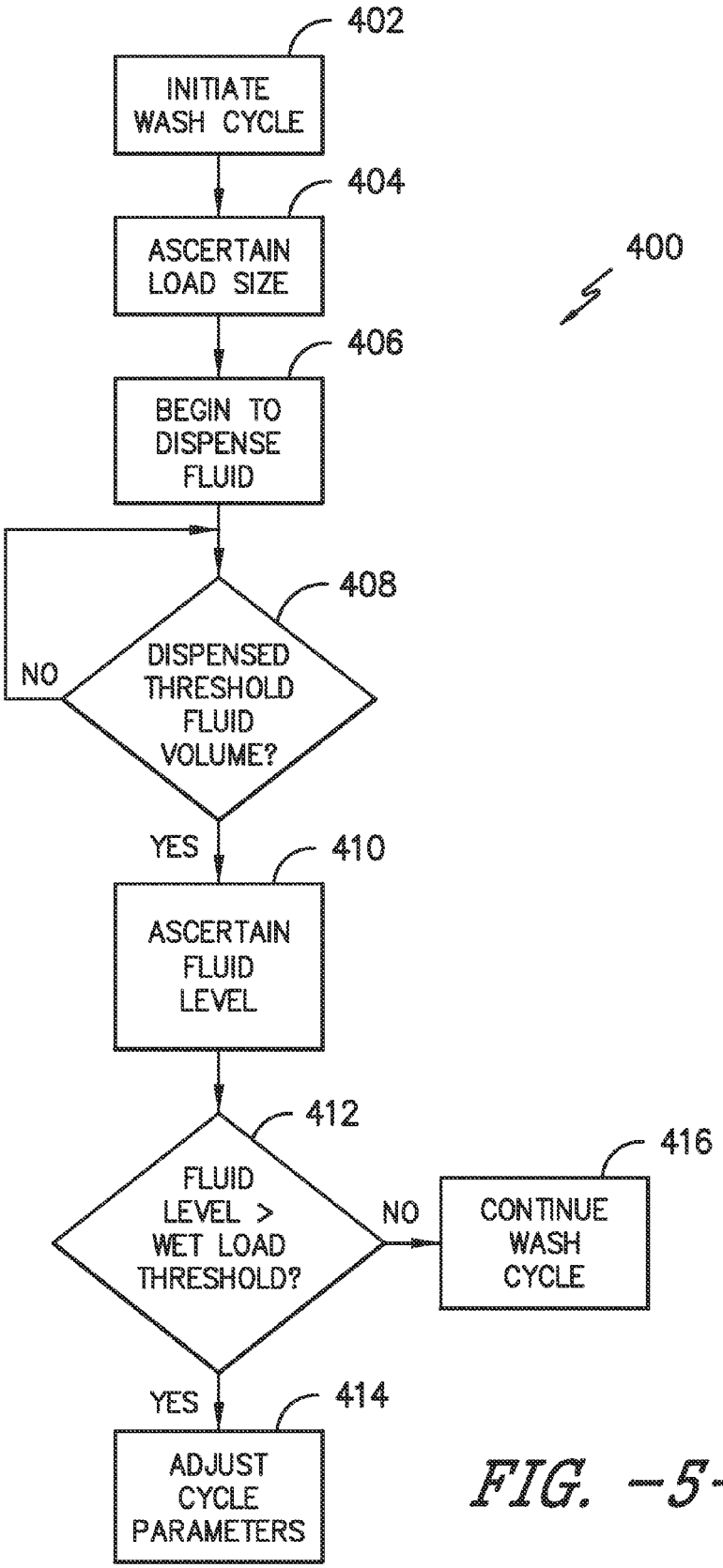
FIG. 5 provides a chart illustrating another exemplary method for operating a washing machine appliance according to the present subject matter.

FIG. 5 illustrates another exemplary method of operating a washing machine appliance according to an exemplary embodiment of the present subject matter. Utilizing method 400, controller 108 can determine whether the articles 160 within wash basket 120 were wet when they were placed in wash basket 120, which can be used to adjust the parameters of the wash cycle to optimize the wash and energy performance of washing machine appliance 100. Method 400 can be used to operate any suitable washing machine appliance, such as washing machine appliance 100 (FIG. 1). Further, method 400 may be programmed into and implemented in whole or in part by controller 108 (FIG. 1) of washing machine appliance 100.

As shown in FIG. 5, at step 402, a wash cycle of washing machine appliance 100 is initiated. The wash cycle may be initiated upon, e.g., the manipulation of one or more input selectors 112 by a user of washing machine appliance 100. The wash cycle may be initiated upon other inputs as well.

Once the wash cycle is initiated, controller 108 ascertains a size of the load of articles 160 in wash basket 120, as illustrated at step 404. In various embodiments, the load size may be ascertained as described above with respect to method 300. Other ways of ascertaining the size of the load of articles 160 within wash basket 120 also may be used.

After the size of the load of articles 160 is ascertained, method 400 includes step 406 of beginning to dispense fluid to wash basket 120. Fluid may be dispensed through, e.g., spout 202 by opening one or more valves as described above. A flow limiter may be included such that a known flow rate is provided from the one or more valves opened to provide a flow of water to spout 202. The fluid dispensed to wash basket 120 may be liquid water or a combination of liquid water and a fluid additive. Additionally, wash basket 120 may be rotated to evenly distribute the dispensed fluid to articles 160 within wash basket 120. Further, where one or more valves are opened to provide a flow of fluid through spout 202, controller 108 may begin counting a time that the one or more valves have been opened.

The dispensed fluid may be absorbed by articles 160 or may begin to accumulate in wash tub 121. At step 408, controller 108 may determine whether a threshold volume of fluid has been dispensed to wash basket 120. The fluid volume may be determined as previously described, e.g., by calculating the volume using the flow rate and time one or more valves have been open, by using a flow meter, or by any other suitable means. The threshold fluid volume may be a predetermined fluid volume, e.g., programmed into controller 108.

If, at step 408, the dispensed fluid volume has not reached the threshold fluid volume, fluid may continue to be dispensed, and method 400 may return to step 408 to determine whether the fluid level has reached within wash tub 121 has reached at least the threshold fluid level. Conversely, if controller 108 determines at step 408 the threshold fluid volume has been dispensed, method 400 proceeds to step 410 and controller 108 ascertains the fluid level within wash tub 121. The fluid level within wash tub 121 may be determined using, e.g., pressure sensor 150, a float switch, or any other suitable device or devices as previously described. Then, at step 412, controller 108 determines whether the fluid level is greater than a wet load threshold level. If not, method 400 proceeds to step 416 and the wash cycle continues.

However, if at step 412 the level of the dispensed fluid is greater than the wet load threshold level, controller 108 may determine that articles 160 were wet when the articles were loaded into wash basket 120 or before fluid was dispensed into basket 120. Similar to method 300, the wet load threshold level may be determined using one or more look-up tables, equations, transfer functions, and/or curves that may be, e.g., generated from experimental or other data and programmed into controller 108. At step 414, controller 108 adjusts one or more parameters of the wash cycle based at least in part on the determination that articles 160 were wet before fluid was dispensed into wash basket 120. The parameters of the wash cycle may include, e.g., a volume of fluid dispensed for the wash cycle, a fluid level of the wash cycle, a stroke of agitator 142, a time articles 160 are agitated, a spin profile, a spin time, a soak time, and an amount of one or more fluid additives dispensed to wash basket 120. Other factors, such as, e.g., the size of the load of articles 160, also may affect which parameters are adjusted and how the parameters are adjusted at step 314. After adjusting the appropriate parameters of the wash cycle, the wash cycle may continue at step 416. In this way, the wash cycle can be optimized for the load of articles 160 within wash basket 120.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating a washing machine appliance, the washing machine appliance having a wash basket positioned within a tub and configured to receive a load of articles for washing, a plurality of valves, a spout configured for directing a flow of water to the wash basket, and a controller in operative communication with the plurality of valves, the method comprising the steps of:

initiating a wash cycle of the washing machine appliance;

beginning to dispense fluid into the wash basket;

determining whether a threshold fluid level has been reached and, if so, then ascertaining a dispensed fluid volume;

determining whether the load of articles was wet before beginning to dispense fluid into the wash basket and, if so, then adjusting one or more parameters of the wash cycle, wherein the controller determines the load of articles was wet before beginning to dispense fluid into the wash basket if the dispensed fluid volume is less than a wet load threshold volume.

2. The method of claim 1, further comprising the step of continuing the wash cycle.

3. The method of claim 1, further comprising, during the step of initiating the wash cycle, the step of ascertaining a size of the load of articles within the wash basket.

4. The method of claim 3, wherein the wet load threshold volume is based at least in part on the size of the load of articles within the wash basket.

5. The method of claim 3, wherein the step of ascertaining the size of the load of articles comprises estimating a mass of the load of articles.

6. The method of claim 3, wherein the step of ascertaining the size of the load of articles comprises detecting a load size input by a user of the washing machine appliance.

7. A washing machine appliance, comprising:

a tub;

a wash basket positioned within the tub, the wash basket configured to receive a load of articles for washing;

a plurality of valves;

a spout configured for directing a flow of water to the wash basket; and a controller in operative communication with the plurality of valves, the controller configured for initiating a wash cycle of the washing machine appliance;

beginning to dispense fluid into the wash basket;

determining whether a threshold fluid level has been reached and, if so, then ascertaining a dispensed fluid volume;

determining whether the load of articles was wet before the controller began to dispense fluid into the wash basket and, if so, then adjusting one or more parameters of the wash cycle, wherein the controller determines the load of articles was wet before the controller began to dispense fluid into the wash basket if the dispensed fluid volume is less than a wet load threshold volume.

8. The washing machine appliance of claim 7, wherein the controller is further configured for continuing the wash cycle.

9. The washing machine appliance of claim 7, wherein the controller is further configured for, during the step of initiating the wash cycle, ascertaining a size of the load of articles within the wash basket.

10. The washing machine appliance of claim 7, further comprising a pressure sensor, and wherein the controller is configured for determining whether the threshold fluid level has been reached based on a signal from the pressure sensor.

11. The washing machine appliance of claim 7, further comprising an agitation element having a variable stroke, and wherein adjusting one or more parameters of the wash cycle comprises varying the stroke of the agitation element.

12. The washing machine appliance of claim 7, wherein the wet load threshold volume varies based on a size of the load of articles within the wash basket.

13. The washing machine appliance of claim 7, wherein determining whether the dispensed fluid volume is less than a wet load threshold volume comprises comparing the dispensed fluid volume to a wet load bounds of a load type curve.

14. The washing machine appliance of claim 7, wherein the wet load threshold volume is a predetermined value that is independent of a size of the load of articles within the wash basket.

* * * * *